US007827842B2

(12) United States Patent
Hase et al.

(10) Patent No.: US 7,827,842 B2
(45) Date of Patent: Nov. 9, 2010

(54) HOT FORGING FACILITY

(75) Inventors: Kazukuni Hase, Tokyo (JP); Hideto Kimura, Tokyo (JP); Takaaki Toyooka, Tokyo (JP)

(73) Assignee: JFE Steel Corporation (JP)

( * ) Notice: Subject to any disclaimer, the term of this patent is extended or adjusted under 35 U.S.C. 154(b) by 349 days.

(21) Appl. No.: 11/921,320

(22) PCT Filed: Jun. 5, 2006

(86) PCT No.: PCT/JP2006/311683

§ 371 (c)(1),
(2), (4) Date: Nov. 30, 2007

(87) PCT Pub. No.: WO2007/007497

PCT Pub. Date: Jan. 18, 2007

(65) Prior Publication Data

US 2009/0126451 A1 May 21, 2009

(30) Foreign Application Priority Data

Jul. 14, 2005 (JP) ..... 2005-205171
Apr. 28, 2006 (JP) ..... 2006-126751

(51) Int. Cl.
*B21D 37/16* (2006.01)

(52) U.S. Cl. ..... 72/342.2; 72/69; 72/364

(58) Field of Classification Search ..... 72/69, 72/201, 342.1, 342.2, 342.5, 356, 364; 148/639, 148/643, 644, 647, 649, 654
See application file for complete search history.

(56) References Cited

U.S. PATENT DOCUMENTS 2,193,819 A * 3/1940 Kessler et al. ..... 514/762
2,529,689 A * 11/1950 Hess ..... 148/591
2,835,960 A * 5/1958 Rork ..... 29/889.23
3,889,510 A * 6/1975 Yamakoshi et al. ..... 72/364
4,709,569 A * 12/1987 Sabroff et al. ..... 72/340
5,188,680 A * 2/1993 Hahn et al. ..... 148/593
6,127,044 A * 10/2000 Yamamoto et al. ..... 428/603
6,394,793 B1 * 5/2002 Bunge ..... 432/85
6,539,765 B2 * 4/2003 Gates ..... 72/69
6,555,250 B2 * 4/2003 Shah et al. ..... 428/652
7,308,813 B2 * 12/2007 Koike ..... 72/69

(Continued)

FOREIGN PATENT DOCUMENTS

JP 62-130737 A 6/1987

(Continued)

OTHER PUBLICATIONS

"Plastic Processing Technology Series 4: Forging," The Japan Society for Technology of Plasticity, published by Corona.

*Primary Examiner*—Edward Tolan
(74) *Attorney, Agent, or Firm*—DLA Piper LLP (US)

(57) ABSTRACT

A hot forging facility enabling the manufacture of a hot forged product excellent in fatigue properties and cold workability is provided. A heating furnace for heating a steel material and a hot forging apparatus for performing forging of the heated steel material are sequentially arranged on a transport line. A partially cooling apparatus/apparatuses for partially cooling a forged product after hot forging is provided on an exit side of the hot forging apparatus.

18 Claims, 4 Drawing Sheets

U.S. PATENT DOCUMENTS

| | | | | |
|---|---|---|---|---|
| 7,503,116 | B2 * | 3/2009 | Machrowicz et al. | ..... 29/897 |

FOREIGN PATENT DOCUMENTS

| | | | |
|---|---|---|---|
| JP | 03-075305 | | 3/1991 |
| JP | 06-306460 | | 11/1994 |
| JP | 9-276971 | A | 10/1997 |
| JP | 10-211504 | A | 8/1998 |
| JP | 10-245636 | A | 9/1998 |
| JP | 2936198 | B2 | 6/1999 |
| JP | 3100492 | B2 | 8/2000 |
| JP | 2000-337345 | A | 12/2000 |
| JP | 2006-181606 | A | 7/2006 |
| KR | 1998-42752 | | 8/1998 |
| KR | 1998-72267 | | 11/1998 |
| KR | 2005-63515 | | 6/2005 |
| WO | WO 97/10066 | A1 | 3/1997 |

* cited by examiner

HOT FORGING FACILITY

RELATED APPLICATION

This is a §371 of International Application No. PCT/JP2006/311683, with an international filing date of Jun. 5, 2006 (WO 2007/007497 A1, published Jan. 18, 2007), which is based on Japanese Patent Application Nos. 2005-205171, filed Jul. 14, 2005, and 2006-126751, filed Apr. 28, 2006.

TECHNICAL FIELD

This disclosure relates to a hot forging facility for manufacturing various hot forged products, of which typical examples include machine structural components represented by, for example, steel-using automobile components such as suspension components including, for example, constant-velocity universal joints and hubs, and engine components such as crankshafts.

BACKGROUND

According to a general practice, steel products for the use of, for example, automobile axle unit and engine components, are each manufactured in the manner that the product is hot forged, and thereafter is finished by a machining process (or, "machined and finished," herebelow). A manufacturing process for such a component is disclosed in, for example, "Plastic Processing Technology Series 4: Forging," The Japan Society for Technology of Plasticity, published by Corona. The manufacturing process is carried out by processing steps representative of forging production processing steps. More specifically, a material is machined and heated and, thereafter, the thus-processed material is shaped or formed by a forging step and, by necessity, the formed material is heat treated.

Recently, it is increasingly demanded that products for the above-described use be improved in fatigue strength for implementation of, for example, compactness and thinning for weight reduction of automobiles using those products.

In Japanese Patent No. 3100492, as a technique for increasing the fatigue strengths of hot forged products, there is disclosed a manufacturing method for a high fatigue strength hot forged product. According to the method, the entirety of a forged product is hardened or quenched after hot forging and, further, the matrix thereof is precipitation hardened by tempering processing.

Further, Japanese Patent No. 2936198 discloses a cooling apparatus operating such that cooling rate nonuniformity in the entirety of a forged product is eliminated, thereby to control the overall cooling rate for the product.

However, according to the method disclosed in Japanese Patent No. 3100492, the component (product) itself is directly cooled after hot forging, such that the hardness of the entirety of the component is increased, and hence the workability of an area not requiring fatigue strength is reduced. More specifically, according to a general practice, a machine structural component for the above-described use is manufactured in the manner that the material is formed by hot forging into substantially the product shape and, thereafter, the entire surface of the hot forged product is machined and finished. As such, in the manufacture of a machine structural component of the above-described type, the machining process and surface abrading are indispensable. However, in the event that the hardness of the entirety of the component is increased, reduction in machinability inevitably poses a significant problem.

In addition, a manufacturing facility for implementing the above-described method requires a heating facility to provide separate quenching for the precipitation hardening treatment. As such, the facility is not preferable even from the viewpoint of energy saving.

Similarly, the technique described in Japanese Patent No. 2936198 controls the cooling rate of the entirety of the workpiece, such that reduction in machinability poses a significant problem.

Under these circumstances, for the facility described in either of Japanese Patent Nos. 3100492 and 2936198, it is difficult to provide a hot forged product excellent in fatigue properties and cold workability. More specifically, it is difficult for the disclosed facility to provide such a hot forged product that has high fatigue strength, which is required from stress occurred in association with, for example, weight reduction and compactness of the forged product, relative to the forged product obtained from the conventional method, and that has high machinability not only for, of course, an area not requiring fatigue strength, but also for other areas when machining is performed after hot forging, thereby making it possible to be easily finished.

Accordingly, it could be advantageous to provide a hot forging facility enabling manufacturing of a hot forged product excellent in fatigue properties and cold workability.

SUMMARY

We discovered the following as a result of our efforts:

(I) When a hardness increase rate of an area of a hot forged product reaches 10% or higher after partial cooling of a specifically fatigue-strength required area, the fatigue strength of the product as a component can be increased by 20% or higher.

(II) An area partially quenched by partial cooling is self-tempered by the quantity of holding heat of a non-cooled area. As a consequence, effectiveness equivalent to the effectiveness after the tempering process conventionally performed as the additional processing step can be obtained. In order to obtain the effectiveness, the tempering process has to be performed to satisfy a specific parameter.

(III) Consequently, the forged product does not have to be additionally tempered after being cooled to the ambient temperature, therefore making it possible to manufacture a high fatigue strength component at low cost.

We therefore provide:

(1) In a hot forging facility wherein a heating furnace for heating a steel material and a hot forging apparatus for performing forging of the heated steel material are sequentially arranged on a transport line, a partially cooling apparatus/apparatuses for partially cooling a forged product after hot forging is provided inside of and/or on an exit side of the hot forging apparatus.

(2) In a hot forging facility as described in (1), the partially cooling apparatus includes a nozzle for spraying cooling liquid towards a part of the forged product.

(3) In a hot forging facility as described in (1) or (2), at least one unit of the partially cooling apparatus is provided in a position along the transport line on an exit side of the hot forging apparatus.

(4) In a hot forging facility as described in any one of (1) to (3), a plurality of the partial cooling apparatuses are provided in positions along the transport line on an exit side of the hot forging apparatus.

Accordingly, a facility for securely implementing the manufacture of a hot forged product excellent in fatigue properties and cold workability can be provided.

REFERENCE NUMERALS

Figure 3:
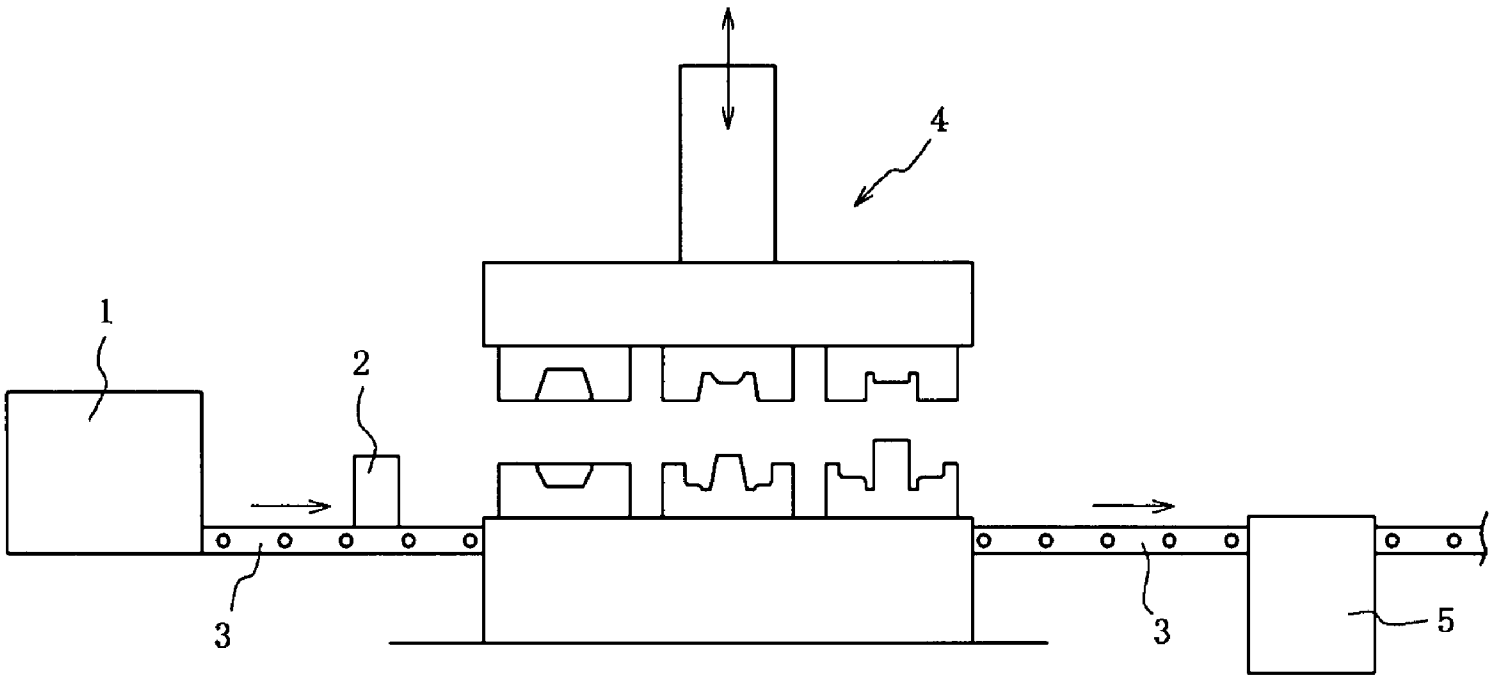
FIG. 3 is a view showing the configuration of a hot forging facility.
Figure 4:
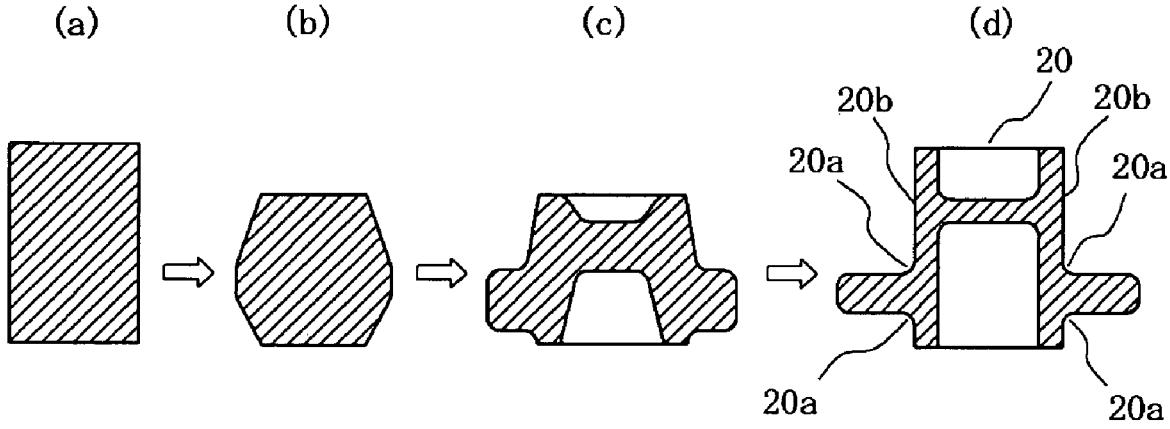
FIG. 4 is a process view showing a procedure of hot forging.
Figure 5:
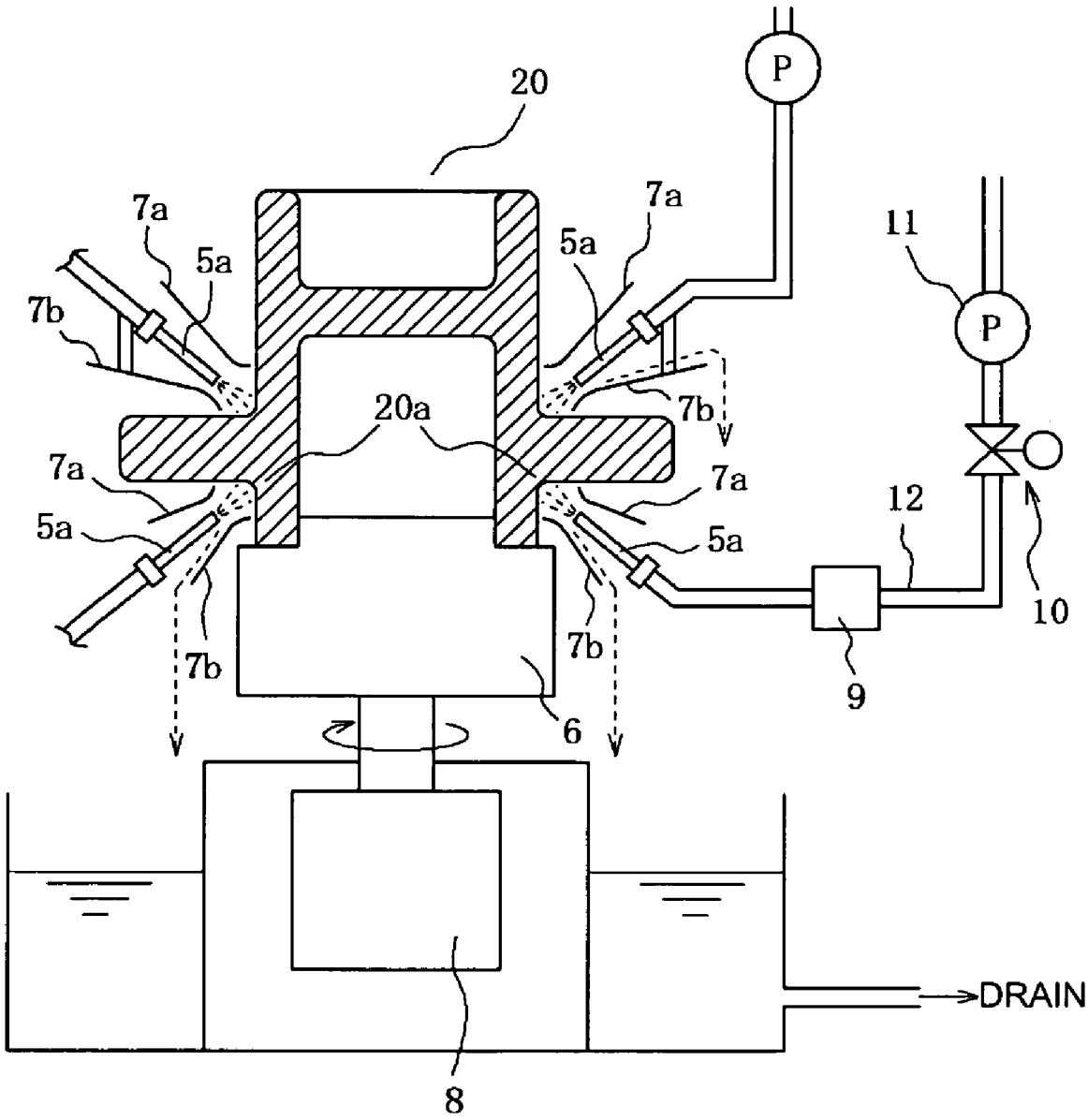
FIG. 5 is a view showing a partially cooling apparatus.

Reference numerals in FIGS. 3 to 5 are as follows:

1 Heating furnace
2 Steel material
3 Transport line
4 Hot forging apparatus
5 Partially cooling apparatus
20 Hot forged product
20*a* Flange base portion
20*b* axial end portion

DETAILED DESCRIPTION

First, in order to obtain a hot forged product excellent in fatigue properties and cold workability, it is preferable that a hardened area is provided in a specifically fatigue-strength required area of a forged product by performing partial cooling after hot forging, and other areas are remained as an un-hardened area, in which a Vickers hardness $V_1$ of the hardened area, particularly, on a surface and a Vickers hardness $V_2$ of the un-hardened area satisfy an expression:

$$(V1-V2)/V_2:0.1\sim0.8.$$

More specifically, when the ratio "$(V_1-V_2)/V_2$" is less than 0.1, a strength increase of the hardened area is insufficient, such that sufficient strength improvement effectiveness cannot be obtained. On the other hand, however, if the ratio "$(V_1-V_2)/V_2$" exceeds 0.8, then the hardness is excessively increased, thereby significantly reducing cold workability, such as machinability. Especially, since direct partial quenching is directly performed after hot forging, subsequent machining process is indispensable, so that it is recommended that the hardness ratio "$(V_1-V_2)/V_2$" is set to 0.8 or less. An optimal range of the ratio is from 0.2 to 0.6.

The hardened area having the hardness difference is structured from martensite and/or bainite. The un-hardened area is primarily structured from ferrite and/or pearlite, but, depending on the case, can partly be mixed with bainite.

Thus, the hot forged product is obtained through the direct partial quenching after hot forging, and then is formed into a machine structural component through a mechanical finishing process. In this case, hot forging refers to the step of performing forging by heating the material to a temperature of $A_{c3}$ or higher.

Manufacture conditions for manufacturing the hot forged product satisfying ratio "$(V_1-V_2)/V_2$:0.1~0.8" will be described herebelow.

More specifically, following the general manufacturing method for components of the above-described type, the steel material is heated and fed into the hot forging apparatus. In the present case, however, it is essential that a partial cooling process is performed to cool down the forged product having been obtained as described above, from a temperature of $A_{c3}$ or higher to a temperature of Ac1−150° C. or lower at a rate of 20° C./s. More specifically, an area of the product required to have a high fatigue strength after hot forging is cooled down from a temperature of $A_{c3}$ or higher to a temperature of $A_{c1}$−150° C. or lower at a cooling rate of 20° C./s. Thereby, ferrite development or transformation during cooling can be suppressed, and the structure can be transformed to martensite and/or bainite.

Thus, partial cooling after hot forging is performed within the temperature range of from $A_{c3}$ or higher to $A_{c1}$−150° C. or lower. It is indispensable to perform cooling from $A_{c3}$ or higher in order to obtain a sufficient heat recuperation effect after cooling; and cooling is performed to $A_{c1}$−150° C. or lower is to suppress ferrite development or transformation.

The cooling rate within the temperature range is set to the cooling rate of 20° C./s in order to transform the structure into martensite and/or bainite while suppressing the ferrite transformation.

Thereafter, it is important to cause the component to be quenched by heat recuperation in accordance with the holding heat of the component within the temperature range not continually exceeding the $A_{C1}$ point. More specifically, when the quenching temperature associated with the heat recuperation exceeds the $A_{C1}$ point, the structure formed by partial quenching is retransformed into an austenite structure and is transformed into a ferrite-pearlite structure. To prevent this, it is important to cause the component to be quenched within the temperature range not exceeding the $A_{C1}$ point.

In the case of quenching using the heat recuperation, it is preferable that, during a time period from the instance of stop of cooling to the instance wherein the temperature reaches 300° C. in the stage of temperature falling after the heat recuperation, a parameter H defined by expression (1) below from an average temperature $T_n$(K) in units of a time period $\Delta t_n$ (second) satisfy $$65 \leqq H \leqq 85$$

$$H=\log_{10}\Sigma 10^{f_n} \quad (1),$$

where $f_n=\log \Delta t_n-1.597\times10^4/T_n+100$.

Figure 1:
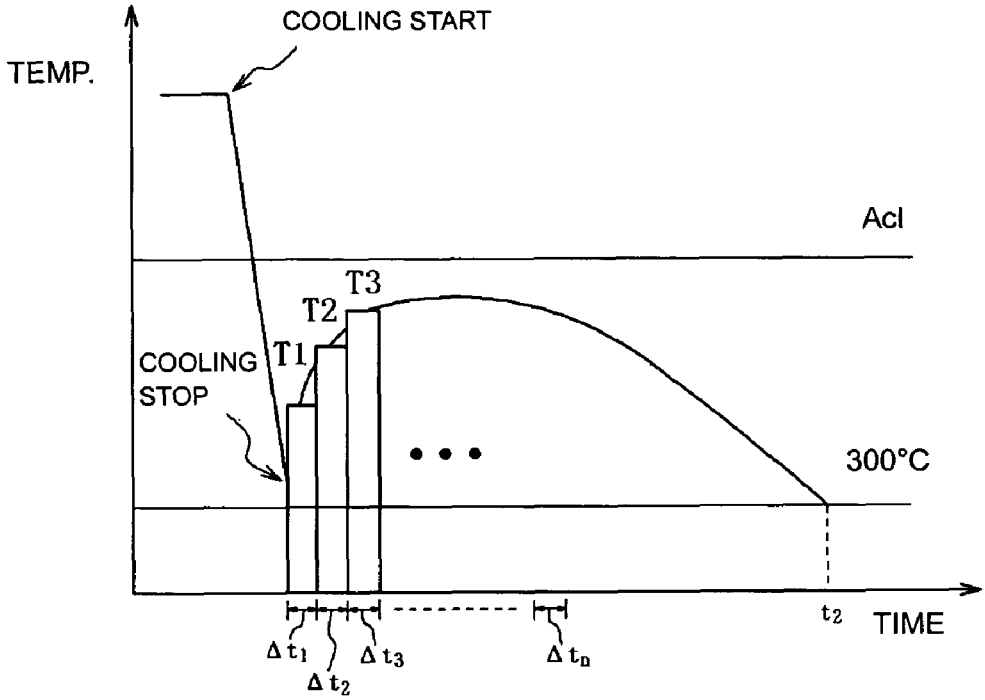
FIG. 1 is a conceptual diagram of a temperature history in heat recuperation.

FIG. 1 shows a temperature history in the event of heat recuperation of a partially cooled area. With reference to FIG. 1, an average temperature $T_n$(K) in each time period $\Delta t_n$ is obtained from a cooling curve after stop of cooling, and the resultant value is adapted in expression (1), whereby the parameter H is defined. In this case, since the temperature $T_n$ in the stage of self-tempering continually varies, the temperature is obtained by assuming $\Delta t_n$ to 0.5 seconds or less.

Figure 2:
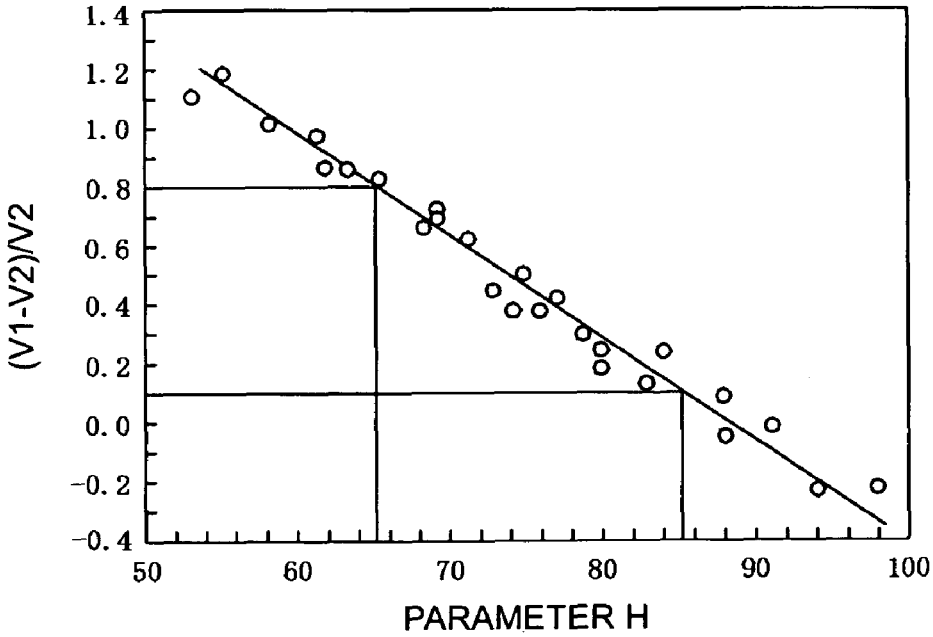
FIG. 2 is a diagram showing the relationship between a parameter H and "$(V_1-V_2)/V_2$".

FIG. 2 shows the relationship between the ratio "$(V_1-V_2)/V_2$" and the parameter H. As shown in FIG. 2, the parameter H and the hardness ratio are in a good interrelationship. When the parameter H is less than 65, the quenching effect is insufficient, the hardness ratio "$(V_1-V_2)/V_2$" exceeds 0.8, therefore posing the problem with the machinability. When the parameter H exceeds 85, the component is excessively softened to the extent that the ratio "$(V_1-V_2)/V_2$" is less than 0.1 at which fatigue strength improvement effects cannot be obtained.

As described above, in order to obtain the hot forged product excellent in fatigue properties and cold workability, partial cooling after hot forging has to be appropriately performed, preferably, in accordance with the parameter H. A hot forging facility for obtaining the product will be described in detail herebelow with reference to FIG. 3.

Referring to FIG. 3, numeral 1 represents a heating furnace for heating the steel material. A hot forging apparatus 4 is disposed on a transport line 3 of a heated steel material 2 extending toward an outlet side of the heating furnace 1. A partially cooling apparatus 5 is disposed in a position along the transport line 3 on an exit side of the hot forging apparatus 4.

In the hot forging apparatus 4, the heated steel material 2 is formed into a desired shape by die forging. For example, in the hot forging apparatus 4, through processing steps respectively shown in FIGS. 4(*b*) to 4(*d*), a steel material 2 shown in FIG. 4(*a*) is formed into a forged product 20 having a pre-finishing product shape.

Subsequently, a specified area of the forged product 20 is cooled in the partially cooling apparatus 5 disposed on the exit side of the hot forging apparatus 4. For example, as shown in FIG. 5, a plurality of nozzles 5*a* are provided towards the forged product 20 in a plurality of circumferentially equi-sectional positions of two portions, namely upper and lower portions, of the forged product 20. Cooling liquid is sprayed from the nozzles 5*a* towards, for example, flange base portions 20*a* of the forged product 20, thereby making it possible to perform localized cooling of the flange base portions 20*a*.

A partially cooling apparatus shown in FIG. 5 includes a turn table 6 that is used for placing the forged product 20 and that is turnable by a motor 8. The plurality of nozzles 5*a* are positioned and fixed to inject cooling water to the flange base portions 20*a* placed on the table 6. The nozzles 5*a* are each fluidly connected to a cooling water feed pipe 12. The cooling water feed pipe 12 is provided to include a booster pump 11 for feeding the cooling water, a flow regulation valve 10 for controlling the volume of injection, and a flowmeter 9 for monitoring the flow. Further, upper and lower cooling water partition plates 7*a* and 7*b*, respectively, are provided on upper and lower sides of the respective nozzle 5*a*. The respective plate is thus provided to locally cool only the flange base portions 20*a* of the forged product 20 and to thereby prevent other areas from being cooled. Either of the upper or lower cooling water partition plates 7*a* and 7*b* is formed from an annular partition plate to be capable of preventing even leakage of the cooling water to a not-to-be-cooled area of the forged product 20. Further, even for the turn table 6, a ceramic table is used to prevent dissipation of heat of a portion being in contact with the rotary table 6 of the forged product 20.

According to the partially cooling apparatus thus configured, when the cooling water is injected from the nozzles 5*a* while the turn table 6 is being turned, only the flange base portions 20*a* is cooled, but the other areas are not forcedly cooled. Consequently, only a locally cooled area, that is, the flange base portions 20*a* in the present example, can be quenched. After stop of cooling, then self-tempering is effected using heat transferred from non-locally cooled areas.

In this event, partial cooling is performed, preferably, by using the parameter H described above.

After the partial cooling, radiational cooling is effected. The radiational cooling can be effected either in a bucket (not shown) disposed to a terminal end of the transport line 3 or on the transport line 3.

By using the hot forging facility, described above, cooling localized to the specified area can be securely effected on the hot forged product, consequently making it possible to manufacture the hot forged product satisfying "$(V_1-V_2)/V_2=0.1\sim0.8$."

In the example facility described above, while the single partially cooling apparatus 5 is provided in the position along the transport line 3, a plurality of partially cooling apparatuses 5 can be disposed along the transport line 3. In this case, a plurality of forged products can be partially cooled at substantially the same time, such that the partial cooling process can be implemented corresponding to the forging rate in the same line.

The nozzles 5*a* may be either a plurality of openings provided on an inner side of a ringular pipe or circumferential slit nozzles. For using the alternative nozzles, a non-turnable table may be used instead of the turn table 6. However, it is preferable that the turn table 6 be used to further improve uniformity.

Further, the partition plate 7*a* is provided corresponding to an allowable level of the degree of temperature fall in the not-to-be-cooled area, but is not indispensable.

In the example described above, the partially cooling apparatus 5 is disposed on the side downstream of the forging apparatus. However, the partially cooling apparatus 5 may be provided inside of the forging apparatus to be able to effect cooling immediately after forging. Further, the configuration may be such that, when performing forging at multiple passes, cooling is effected in any inter-pass stage.

EXAMPLES

Steels of chemical compositions shown in Table 1 are refined in a vacuum melting furnace, and are molded into 100 kg ingots. Subsequently, the respective ingot is formed into a 65 mm diameter steel bar by hot forging, and then the steel bar is led into the hot forging facility. First, the steel bar was heated up to 1200° C. in the heating furnace 1, and then was subjected to three hot forging steps as shown in FIGS. 4(*b*) to 4(*d*) in the hot forging apparatus 4. Thereby, a forged product 20 having a flange, as shown in FIG. 4(*d*), were formed. The forged product 20 was immediately transported into the partially cooling apparatus 5 shown in FIG. 5. Then, partial cooling localized to flange base portions 20*a* was effected by injecting the cooling water at a flow range of 10~20 l/min, and then was subjected to radiational cooling. The start temperature of the partially cooled area was set to 780~4150° C.

The respective hot forged product thus obtained was subjected to structure observation, hardness measurement, and machining testing. For comparison, forged products were manufactured through a hot forging and air cooling process and hot forging and entire tempering process that have been conventionally generally used. In this case, after entire quenching, a tempering process was performed to satisfy a condition of "600° C. (tempering temperature)×1 hr."

First, structure observation was carried in such a manner that structure observation samples, respectively, were cut out from a flange base portion 20*a* and axial end portion 20*b* of the respective hot forged product obtained, and "3 vol. % natal" etched microstructures thereof were observed using an optical microscope and an electronic microscope.

Vickers hardness measurement was carried out in such a manner that the Vickers hardness was measured at a 1-mm portions below a skin of each of the flange base portion 20*a* and the axial end portion 20*b* by applying a load of 300 g.

Machinability by machining (cutting) testing was evaluated by outer-circumference machining. More specifically, machining was carried with a carbide tool P10 at a cutting speed of 200 m/min, a cutting depth of 0.25 mm, and a feed of 0.5 mm/rev by spraying a lubricant, and the machinability was evaluated in terms of a time period required for machining the entirety of the respective component. More specifically, evaluation was made in terms of "(t2−t1)/t1," where t2 is the required time relative to a time period t1 required for machining the respective material subjected to the conventional hot forging and air cooling process.

Thus, partial cooling was securely effected by use of the facility of the disclosure. As a result, it was possible to obtain obtaining forged products in each of which the structure of a cooled area is formed from quenched martensite or bainite or a mixture thereof. In addition, and the structure of an area other than the cooled area is formed from ferrite-pearlite or from bainite, and the hardness ratio "$(V_1-V_2)/V_2$" is within the range of 0.14~0.77. Further, the machinability evaluation results are each lower or equal to 1.2 times that of the conventionally processed material and less or equal to about ⅓ times that of the forged product subjected to the conventional entire quenching.

TABLE 1

| Steel | Chemical Composition (mass %) | | | | | | | | | | | | | | | Transformation Point (° C.) | |
|---|---|---|---|---|---|---|---|---|---|---|---|---|---|---|---|---|---|
| No. | C | Si | Mn | Mo | P | S | Al | Cu | Ni | Nb | Cr | Ti | V | B | Ca | $A_{c3}$ | $A_{c1}$ |
| 1 | 0.54 | 0.23 | 0.83 | — | 0.014 | 0.015 | 0.026 | — | — | — | 0.20 | — | — | — | — | 771 | 724 |
| 2 | 0.31 | 0.22 | 0.64 | — | 0.014 | 0.008 | 0.021 | — | — | — | — | — | — | — | — | 807 | 723 |
| 3 | 0.53 | 0.69 | 0.8 | — | 0.015 | 0.015 | 0.019 | — | 0.05 | — | 0.16 | — | 0.03 | — | — | 795 | 736 |
| 4 | 0.45 | 0.66 | 0.55 | 0.36 | 0.010 | 0.010 | 0.030 | 0.16 | 0.21 | 0.021 | — | 0.015 | 0.02 | 0.002 | 0.004 | 817 | 733 |
| 5 | 0.51 | 0.76 | 0.62 | 0.54 | 0.021 | 0.009 | 0.025 | 0.31 | — | — | — | — | — | — | — | 816 | 738 |

$A_{c3} = 910 - 203\sqrt{C} - 15.2Ni + 44.7Si + 104V + 31.5Mo$ $A_{c1} = 723 - 10.7Mn - 16.9Ni + 29.1Si - 16.9Cr$

TABLE 2

| No. | Steel Type | Hot Forging Temp. (° C.) | Cooling Start Temp. (° C.) | Cooling Rate (° C./s) | Cooling Stop Temp. (° C.) | Heat Recuperation Max. Temp. (° C.) | H | Hardened Area Structure | Hardened Area Hv | Un-hardened Area Structure | Un-hardened Area Hv | Hardness Increase Rate (%) | Machining Time Ratio | Remarks |
|---|---|---|---|---|---|---|---|---|---|---|---|---|---|---|
| 1 | 1 | 1200 | 1100 | 35 | 203 | 560 | 80 | M | 332 | F + P | 234 | 42 | 1.1 | Example of the invention |
| 2 | | 1200 | 1150 | 22 | 214 | 620 | 84 | M | 269 | F + P | 236 | 14 | 1.0 | Example of the invention |
| 3 | | 1050 | 980 | 34 | 229 | 370 | 67 | M | 427 | F + P | 241 | 77 | 1.2 | Example of the invention |
| 4 | | 950 | 870 | 60 | 220 | 520 | 78 | M | 346 | F + P | 236 | 47 | 1.1 | Example of the invention |
| 5 | | 810 | 780 | 46 | 219 | 530 | 79 | M | 362 | F + P | 247 | 47 | 1.1 | Example of the invention |
| 6 | | 1150 | 1100 | 38 | 340 | 550 | 81 | B | 301 | F + P | 243 | 24 | 1.0 | Example of the invention |
| 7 | | 1150 | 1100 | 51 | 270 | 540 | 79 | M + B | 354 | F + P | 239 | 48 | 1.1 | Example of the invention |
| 8 | | 1150 | 1100 | 0.5 | — | — | — | — | — | F + P | 231 | — | 1.0 | Comparative Example: Conventional Process |
| 9 | | 1150 | 1100 | 36 | Ambient temp. | — | — | M | 687 | — | — | — | 4.2 | Comparative Example: Entire Quenching, Tempering |
| 10 | 2 | 1100 | 1030 | 26 | 367 | 560 | 83 | M | 296 | F + P | 224 | 32 | 1.1 | Example of the invention |
| 11 | | 1100 | 1030 | 0.7 | — | — | — | — | — | F + P | 226 | — | 1.0 | Comparative Example: Conventional Process |
| 12 | 3 | 1140 | 1050 | 27 | 260 | 530 | 81 | M | 342 | F + P | 267 | 28 | 1.2 | Example of the invention |
| 13 | | 1140 | 1050 | 0.7 | — | — | — | — | — | — | 267 | — | 1.0 | Comparative Example: Conventional Process |
| 14 | 4 | 1080 | 1020 | 23 | 305 | 520 | 79 | M | 339 | B | 285 | 19 | 1.1 | Example of the invention |
| 15 | | 1080 | 1020 | 0.6 | — | — | — | — | — | — | 279 | — | 1.0 | Comparative Example: Conventional Process |
| 16 | 5 | 1120 | 1080 | 42 | 237 | 530 | 76 | M | 319 | B | 264 | 21 | 1.1 | Example of the invention |
| 17 | | 1120 | 1080 | 0.4 | — | — | — | — | — | — | 263 | — | 1.0 | Comparative Example: Conventional Process |

The invention claimed is:

1. A hot forging facility wherein a heating furnace for heating a steel material and a hot forging apparatus for performing forging of the heated steel material are sequentially arranged on a transport line, having a partial cooling apparatus for partially cooling a forged product after hot forging, the partial cooling apparatus being provided at least inside of or on an exit side of the hot forging apparatus, wherein the partial cooling apparatus causes the forged product to have a hardened area of Vickers hardness $V_1$ and an unhardened area of Vickers hardness $V_2$ which satisfies $(V_1-V_2)/V_2=0.1-0.8$.

2. The hot forging facility according to claim 1, wherein the cooling apparatus includes a nozzle for spraying cooling liquid towards at least a portion of the forged product.

3. The hot forging facility according to claim 1, wherein at least one unit of the partial cooling apparatus is provided in a position along the transport line on an exit side of the hot forging apparatus.

4. The hot forging facility according to claim 1, wherein a plurality of the partial cooling apparatuses are provided in positions along the transport line on an exit side of the hot forging apparatus.

5. The hot forging facility according to claim 1, wherein the partial cooling apparatus further comprises a turntable upon which the forged product is positioned.

6. The hot forging facility according to claim 1, wherein the hardened area is formed of martensite and/or bainite and the unhardened area is formed of ferrite and/or pearlite and, optionally, bainite.

7. The hot forging facility according to claim 1, wherein the partial cooling apparatus causes cooling within, a temperature range of from $A_{c3}$ or higher to $A_{c1}-150°$ C. or lower.

8. The hot forging facility according to claim 1, wherein the partial cooling apparatus has an annular partition plate that prevents cooling of not-to-be-cooled portions of the forged product.

9. The hot forging facility according to claim 1, wherein the partial cooling apparatus causes heat recuperation to the temperature exceeding 300° C. and not exceeding the $A_{C1}$ point after the partial cooling.

10. The hot forging facility according to claim 7, wherein the partial cooling apparatus causes heat recuperation to the temperature exceeding 300° C. and not exceeding the $A_{C1}$ point after the partial cooling.

11. A not forging facility comprising:

a heating furnace that heats steel material; and a hot forging apparatus that forges the heated steel material sequentially arranged on a transport line, the hot forging apparatus having a cooling apparatus that partially cools forged products after hot forging is provided at least inside of or on an exit side of the hot forging apparatus, wherein the partial cooling apparatus causes the forged product to have a hardened area of Vickers hardness $V_1$ and an unhardened area of Vickers hardness $V_2$ which satisfies $(V_1-V_2)/V_2=0.1-0.8$.

12. The hot forging facility according to claim 11, wherein the cooling apparatus includes a nozzle for spraying cooling liquid towards at least a portion of the forged product.

13. The hot forging facility according to claim 11, wherein at least one unit of the cooling apparatus is provided in a position along the transport line on an exit side of the hot forging apparatus.

14. The hot forging facility according to claim 12, wherein at least one unit of the cooling apparatus is provided in a position along the transport line on an exit side of the hot forging apparatus.

15. The hot forging facility according to claim 11, wherein a plurality of the cooling apparatuses are provided in positions along the transport line on an exit side of the hot forging apparatus.

16. The hot forging facility according to claim 12, wherein a plurality of the cooling apparatuses are provided in positions along the transport line on an exit side of the hot forging apparatus.

17. The hot forging facility according to claim 13, wherein a plurality of the cooling apparatuses are provided in positions along the transport line on an exit side of the hot forging apparatus.

18. The hot forging facility according to claim 14, wherein a plurality of the cooling apparatuses are provided in positions along the transport line on an exit side of the hot forging apparatus.

* * * * *